United States Patent [19]

Larkin et al.

[11] Patent Number: 4,757,911

[45] Date of Patent: Jul. 19, 1988

[54] CONTAINER AND CLOSURE CONSTRUCTION

[75] Inventors: Mark E. Larkin, Lindenhurst; Edward S. Tripp, Park City; John S. Ziegler, Arlington Heights, all of Ill.

[73] Assignee: Abbott Laboratories, North Chicago, Ill.

[21] Appl. No.: 806,782

[22] Filed: Dec. 9, 1985

[51] Int. Cl.[4] ..... B65D 41/02

[52] U.S. Cl. ..... 220/265; 220/270; 215/249; 215/256; 215/271

[58] Field of Search ..... 215/247, 249, 254, 255, 215/256, 270, 271; 220/265, 270, 271; 604/256, 408, 415; 383/80, 61, 93, 95, 96

[56] References Cited

U.S. PATENT DOCUMENTS

| | | | |
|---|---|---|---|
| D. 271,805 | 12/1983 | Larkin . | |
| 2,034,739 | 3/1936 | Bodor | 215/271 |
| 2,040,798 | 5/1936 | Schoonmaker | 215/271 |
| 2,723,041 | 11/1955 | Hart-Still | 215/270 |
| 3,047,178 | 7/1962 | Piotras et al. . | |
| 3,394,831 | 7/1966 | Bathish et al. . | |
| 3,434,620 | 3/1969 | Laurizio | 220/270 |
| 3,465,910 | 9/1969 | Richie . | |
| 3,509,879 | 5/1970 | Bathish et al. | 604/408 |
| 3,730,376 | 5/1973 | Wood | 220/270 |
| 3,915,212 | 10/1975 | Bujan et al. | 604/408 |
| 3,923,183 | 12/1975 | Choksi et al. . | |
| 3,940,802 | 3/1976 | Sako et al. | 604/408 |
| 3,946,891 | 3/1976 | Picoy et al. . | |
| 3,981,412 | 9/1976 | Asmus | 215/256 |
| 3,999,678 | 12/1976 | Ignell et al. | 220/270 |
| 4,024,952 | 5/1977 | Leitz . | |
| 4,187,893 | 2/1980 | Bujan | 604/415 |
| 4,303,067 | 12/1981 | Connolly et al. | 215/247 |
| 4,307,766 | 12/1981 | Tanokura | 604/408 |
| 4,344,545 | 8/1982 | Aschberger et al. | 220/270 |
| 4,442,949 | 4/1984 | Dwinell et al. | 220/270 |
| 4,506,807 | 3/1985 | Anderson | 215/247 |
| 4,512,486 | 4/1985 | Kobayashi et al. | 215/249 |

FOREIGN PATENT DOCUMENTS 117489 5/1984 European Pat. Off. .

OTHER PUBLICATIONS

Introducing the New LifeCare II Flexible I.V. Container (published 6/81).

The Life Care II System In-Service Guide for Hospital Personnel (published 7/81).

*Primary Examiner*—David T. Fidei

*Attorney, Agent, or Firm*—Neuman, Williams, Anderson & Olson

[57] ABSTRACT

A thin flexible fluid-tight cover of PVC is bonded to a rigid port of a diluent container which is to be subjected to heat sterilization. The cover includes an outer flange for bonding to a complementary surface around the port, and a removable section for spanning the port. The removable section includes a central flexible diaphragm portion and a cylindrical wall portion. The diaphragm portion has at least one annular convolution whereby the diaphragm section is axially expandable by flexing of the convolution. A tear line is provided in a frangible section which joins the cylindrical wall portion to the outer flange. The cylindrical wall portion of the cover is disposed adjacent the outer surfaces of an abutment wall on the port to provide stress relief against rupture of the tear line from stresses generated in the cover during sterilization. A narrow post element is located adjacent the wall portion for concentrating manual pulling forces from an attached pull ring to a limited segment of the tear line.

40 Claims, 6 Drawing Sheets

CONTAINER AND CLOSURE CONSTRUCTION

This invention pertains to a closure for a container having a frangible seal. More particularly this invention relates to a port closure which is particularly useful in containers such as diluent bags which are subjected to heat sterilization procedures.

Systems involving packaging of a medicament and a diluent in separate containers which may be connected to one another at the time of use for convenient safe mixing of the medicament and diluent are known in the art. By preparing such mixtures just prior to use, the problems attendant to the deterioration of mixtures having short shelf life are avoided. Such container systems currently are sold by Abbott Laboratories of North Chicago, Ill. under the trademark ADD-VANTAGE. A number of embodiments of such systems are disclosed in U.S. patent application Ser. No. 565,126 of Mark E. Larkin, filed Dec. 23, 1983, which (now U.S. Pat. No. 4,614,567) is assigned to the assignee of this invention. The disclosure of such application is incorporated herein by reference.

Such dual container systems are of particular importance in the health care field wherein containers such as I.V. bags having standard diluents, such as a normal saline solution, dextrose or water, are provided for subsequent connection of any selected medicament container, such as a vial, containing the appropriate medicament in accordance with each individual prescription. In such a system the additive medicament, which may be solid (powder) or liquid, is added as a precise predetermined quantity into a precise quantity of diluent. Each diluent container has a port to which the medicament container may be connected, e.g., by inserting one end or neck of the medicament container and securing the containers together as by threadable engagement in the port.

As noted in the aforementioned application, Ser. No. 565,126, the ends and ports of such containers which are to be connected preferably are provided with removable closures or covers to maintain sterility of various components during shipping and handling. The protective closures or covers typically are applied prior to sterilization, particularly in the case of diluent containers. The closures covering the port and vial neck subsequently are removed, usually by a health care person, just prior to interconnecting the two containers. Closures embodying this invention are particularly adapted for the ports of such diluent containers, although their applicability to a large variety of containers will become apparent after a reading of the following description.

There are several requirements for such closures. It is necessary in medical field applications that the closures for the two containers of the system maintain effective seals until the time of deliberate removal. The closures must be of adequate strength so as not to rupture during handling and transport, with resultant leakage or contamination of the contents. The container closures also should be of designs which will allow relatively easy and convenient removal by the user.

The closure on the diluent container also must withstand the conditions encountered during sterilization. Typically this is steam sterilization in which the entire container is subjected to high heat, moisture, and both positive and negative pressure differentials across the closure. These pressure differentials of course generate stress in the closure with the stresses being greater in the instance of closures for larger ports such as are required for interconnection of a vial end with a diluent container.

The port structure of a diluent container closure typically is molded of a relatively rigid material such as a polyester which is dimensionally stable within sterilizing temperature ranges, to insure maintenance of its designed configuration and dimensions for subsequent mating connection of a vial or other container. The cover member of the closure must meet differing requirements. The cover should be flexible to allow volumetric changes of the space which is enclosed within the port or container to minimize pressure differentials across the cover. It must withstand anticipated stresses and yet must be tearable to facilitate intentional removal of a portion of the cover by the user for subsequent exposure of the port. Further, it is desirable that the cover member be weldable to the port for convenient sealing attachment. Materials meeting these requirements for the cover may have different coefficients of expansion than the port structure to which they are secured, leading to additional stresses during sterilization. For example, plasticized polyvinyl chloride (PVC) plastics have desirable properties for use as a cover and have been approved by the United States Food and Drug Administration for pharmaceutical containers. However, such PVC materials often have a negative coefficient of expansion and tend to distort and shrink during autoclave sterilization. Apparently due to such characteristics, a problem has been encountered by way of rupturing of the tear lines in large port covers formed of such PVC when used with ports molded of polyester in closures of conventional design.

It is an object of this invention to provide port closures which meet the aforenoted requirements.

It is another object of this invention to provide a port closure which is formed with an expansible diaphragm. The diapragm minimizes pressure differentials imparted to opposed faces of the closure during sterilization of such closure in an autoclave, thereby protecting the closure frangible section from the effect of such forces and attendant rupture.

It is another object of this invention to provide a port closure which effects stress relief to prevent the imparting of tensile forces to a frangible closure section in the course of contraction of said closure or the occurrence of tensile forces therein from other causes.

It is yet another object of this invention to provide a closure which reduces the risk of rupture in the course of sterilization and handling, and yet provides desired ease of opening at the time of use.

It is a further object of this invention to provide a cover construction which is readily formed as a unitary element by injection molding and which facilitates assembling in the desired sealing position on a port.

It is another object of this invention to provide a cover construction which facilitates deliberate initiation of tearing within a tear line by the user.

It is a still further object of this invention to provide a port with a captured sterile volume of air thereby reducing or eliminating the inrush of air upon opening of the closure and reducing the risk of contamination.

The above and other objects of this invention will become more apparent from the following detailed discussion when read in the light of the accompanying drawing and appended claims.

In accordance with one embodiment of this invention a cover member containing a frangible section is located over the end of a rigid port of a diluent container. The diluent container is a flexible plastic bag. The port extends through the wall of the bag to define an inlet passage and is adapted to engage with a medicament vial. The port provides a sealed passage between the vial and the diluent compartment within the bag. Thus, a vial will engage the port for purposes of dispensing a medicament into the diluent contents of the bag. The port structure includes an annular attachment surface about the inlet passage, in the form of an annular flange, and a support portion in the form of an annular wall projecting outwardly from that flange. The annular wall thus defines external support surfaces which are disposed about the outer end or opening of the port and which extend outwardly from the flange generally parallel to the central axis of the port.

The cover is a single integral molded member of thin flexible plastic material. It comprises a peripheral portion in the form of an annular flange adapted to sealingly engage the annular flange of the port. A concentric cylindrical wall portion is positioned to be closely adjacent to or to abut the external support surfaces of the annular wall of the port. A circular tear line defines a frangible seal which is located between the cylindrical wall portion and the peripheral portion of the cover. The upper portion of the cylindrical wall projects beyond the annular wall of the port and is joined to an expansible diaphragm section which spans the central portion of the cover. The diaphragm section thus spans the outer end of the port and includes an expandible section in alignment with the port passage.

In the normal position of assembly of the cover on the port, any pressure differential resulting from differing pressures imparted to the inner and outer surfaces of the cover are reacted to by movement of the central diaphragm portion of the closure. As the cover member is stressed by contraction or distortion of the cover material and/or by the forces generated by pressure differentials thereacross, as during autoclaving, the annular wall configuration of the port and the cover apparently mitigate or prevent the application of radial tensile forces to the tear line.

A pull ring is connected to the cover section within the tear line for tearing of the frangible seal and removal of the respective cover section to expose the port.

For a more complete understanding of this invention reference will now be made to the drawings wherein.

DETAILED DESCRIPTION OF THE ILLUSTRATED EMBODIMENTS

Figure 4:
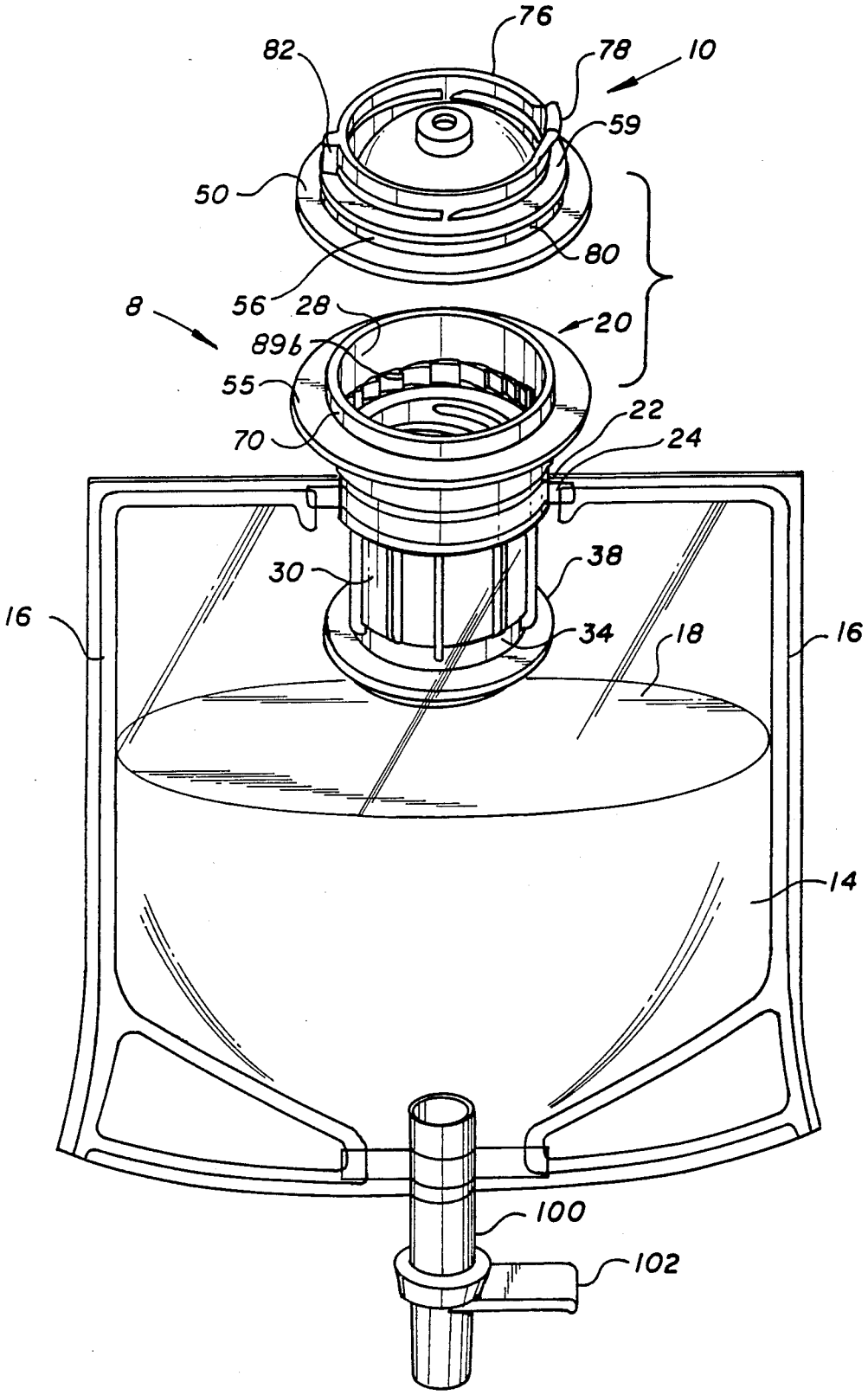
FIG. 4 is a perspective exploded view of a diluent container employing teachings of this invention.
Figure 10:
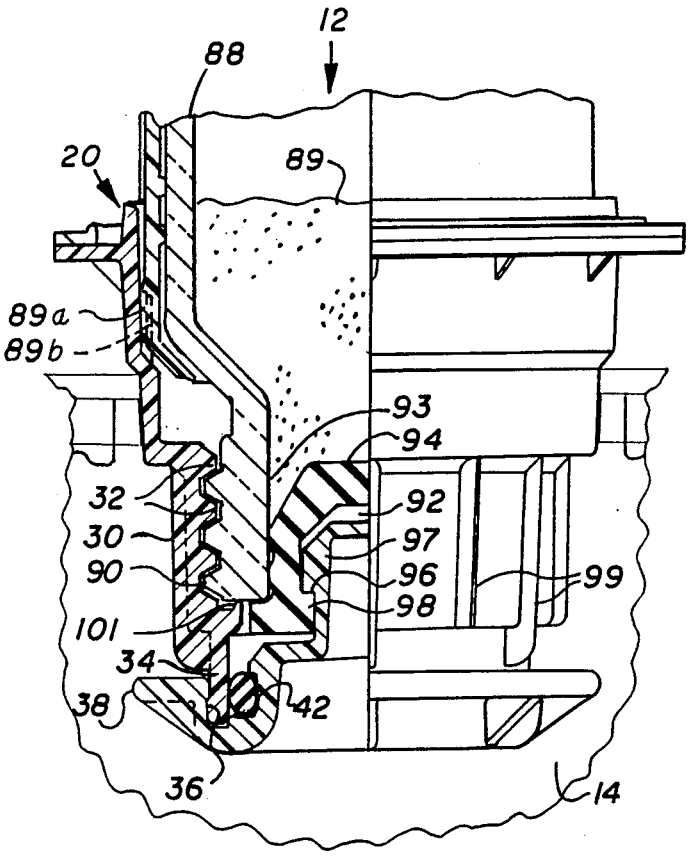
FIG. 10 is a transverse sectional view partly in elevation illustrating a medicament vial in engagement with a diluent container after the cover of the diluent container port has been removed and before the inner port closure and vial stopper have been removed.

Referring now more particularly to FIG. 4, a flexible container 8 includes a flexible bag 12, a vial port 20 with a cover member 10 and an administration port 100. The cover is attached to the port as in FIGS. 5–7 during autoclaving, shipping and handling of the container. The port 20 is designed to receive and engage a medicament vial as illustrated in FIG. 10, upon removal of the central portion of the cover 10 (see FIG. 8), for addition of a selected medicament to a diluent 18 in the bag. The administration port 100 may be of conventional design such as for filling of the bag, addition of other additives, or attachment of an I.V. tube or other extraction means.

The flexible container 12 is formed from two sheets 14 of flexible plastic material which are sealed along their edge portions at 16. The diluent 18 may thus be contained without leakage between the opposed walls 14 of the container 12. The port 20 defines a passageway therethrough for interconnecting the interior of the bag 12 with the exterior and is in fluid-tight engagement through an edge opening 22 by means of mandrel seal 24.

The port 20 is a generally tubular, hollow, relatively rigid member preferably formed of a temperature-stable material, such as a polyester resin which is substantially unaffected by temperature changes encountered in the course of autoclaving for sterilization purposes. This will assure maintenance of the configuration and dimensional tolerances of the port for mating reception of a vial and to maintain the inner seal closure 38 referred to below. The port 20 has an opening 28 exteriorly disposed of the bag 12. An annular flange 55 circumscribes the open end 28, and a cover support wall or "fence" 70 extends outwardly therefrom, as discussed further below. As is more apparent from FIGS. 5 through 8 of the drawing, the body portion 30, which is concentric with the outer opening 28, has threads 32 formed on its inner periphery. The portion 30 terminates in a distal cylindrical portion 34 having an annular bead or ridge 36 integrally formed therewith. The latter ridge has a larger outer diameter than the cylindrical portion 34.

As is also illustrated in FIGS. 5 through 8, a closure or cap 38 for the inner end of port 20 has an inwardly projecting lip 40 which engages annular ridge 36 of the terminal portion 34 in a snap-fit engagement. A fluid-tight sealing engagement is maintained between the cap 38 and the terminus of the port 20 by means of a compressible and deformable O-ring 42 which is compressed in fluid-sealing engagement between the opposed surfaces comprising the inner peripheral surface 46 of the portion 34 and an opposing cylindrical surface 48 on the center portion of cap 38.

The cover member 10 typically is applied to the container prior to sterilization. It effects a desired fluid-tight seal closure over the outer end of port 20 to prevent contamination and maintain sterility within the port from the time of sterilization until the container is being prepared for use. That preparation typically is done by a health care person, usually at bedside. The cover 10 also will prevent loss of any liquid contents through port 20 in the event of leakage or inadvertent removal of closure 38. The cover member 10 may be formed of known flexible polyvinyl chloride compositions having inert fillers as known in the trade for purposes of providing a desired ease of tearing of a frangible seal contained therein.

Figure 1:
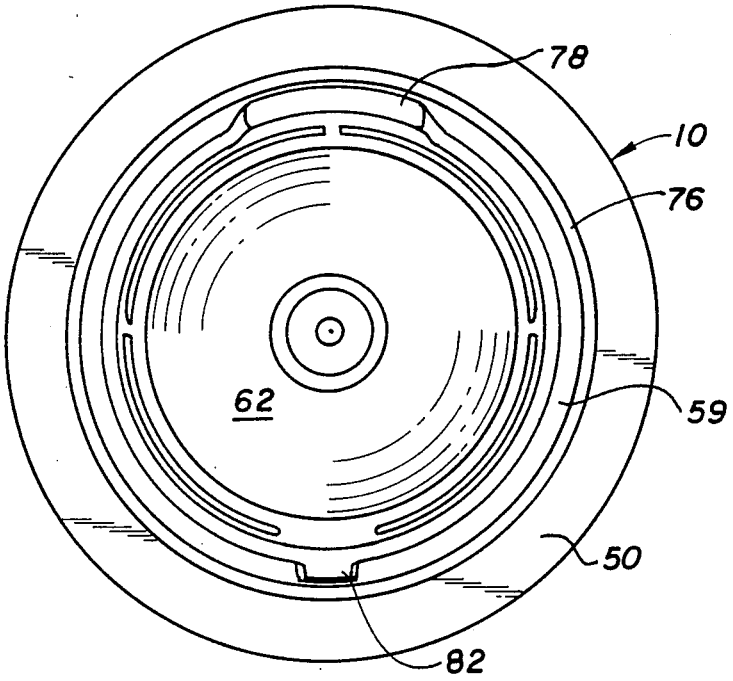
FIG. 1 is a plan view of a cover employing teachings of this invention.
Figure 2:
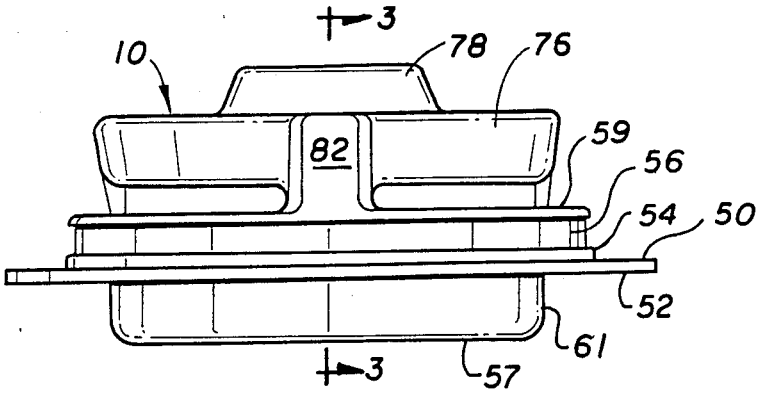
FIG. 2 is a front elevational view of the cover of FIG. 1.
Figure 3:
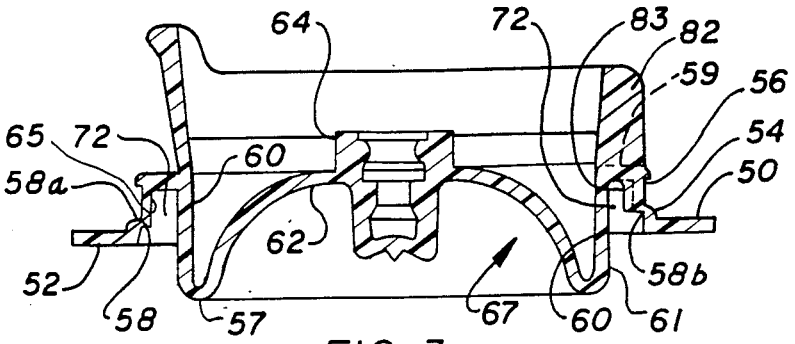
FIG. 3 is a transverse sectional view taken on line 3—3 of FIG. 2.

Referring now more particularly to FIGS. 1 through 3, the cover member 10 comprises a peripheral flange 50 which has a planar undersurface 52. The surface 52 is adapted to be secured to the upper surface of the annular flange 55 on port 20, see FIGS. 4–8. A fluid-tight seal between the surface 52 and upper surface of flange 55 may be effected by heat or sonic welding between the engaged surfaces. Any means for effecting a desired fluid-tight seal between the two annular surfaces may of course be employed.

As is most clearly seen from FIG. 3 of the drawing the inner edge of the flange 50 is integrally formed with an annular bead 54 which defines the juncture between the flange 50 and a vertical cylindrical wall portion 56, see FIG. 2. A thin portion or section of the cover, at 58, between two sharp corners 58*a* and 58*b*, defines a tear line around the cover and which thus forms a readily frangible continuous membrane at the juncture between bead 54 and wall 56 which maintains the fluid-tight integrity of the cover.

The wall 56 is joined at its upper end to the outer periphery of an annular portion 59 of a diaphragm section 67, see FIGS. 1, 3 and 4. The latter annulus is concentric with flange 50 and bead 54. Integral with and depending from the inner peripheral edge of annulus 59 is a diaphragm 57 comprising a depending, cylindrical wall portion 60 which has an outer cylindrical surface 61 more clearly seen in FIG. 2. The bottom end of wall 60 is continuous by means of a reverse bend or convolution with a dome-shaped diaphragm portion 62. The wall portion 60 and dome portion 62 define a flexible diaphragm which serves to complete the fluid-tight closure cross section spanning the annular flange 50. Center hollow element 64 of diaphragm 57 (FIG. 3) is of a configuration dictated by the specific mold elements employed in the course of injection molding of the cover 10, and thus may be varied from the configuration illustrated, or omitted as desired, subject to maintaining the integrity of the cover.

Figure 5:
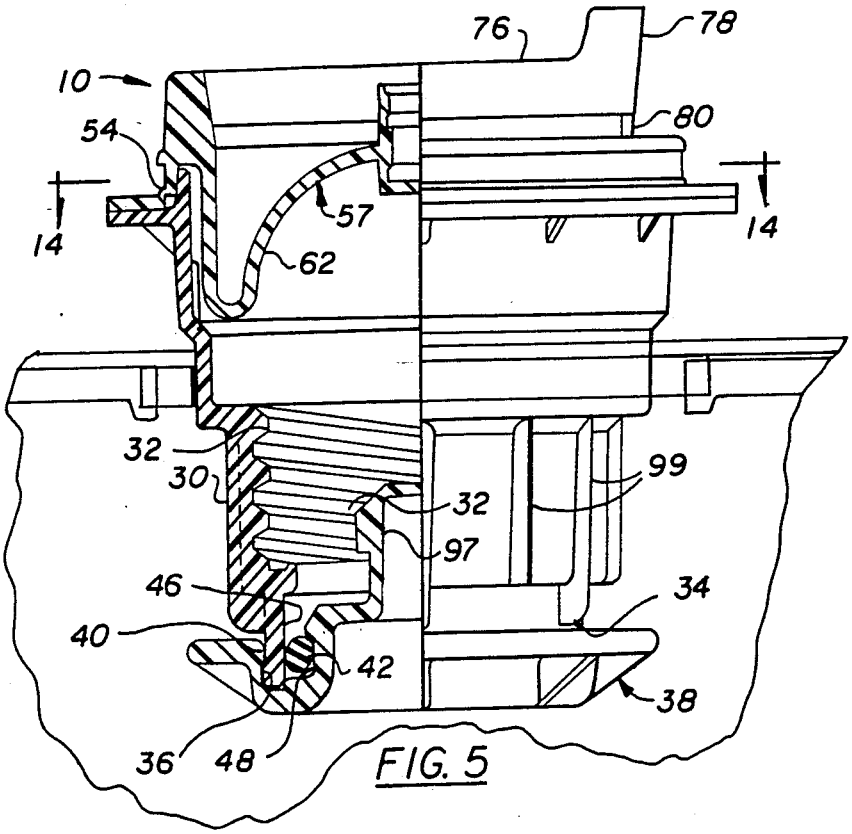
FIG. 5 is a partial sectional view of the closure of the container of FIG. 4 in a normal position of assembly, i.e., with the cover in fluid sealing engagement with the port.
Figure 6:
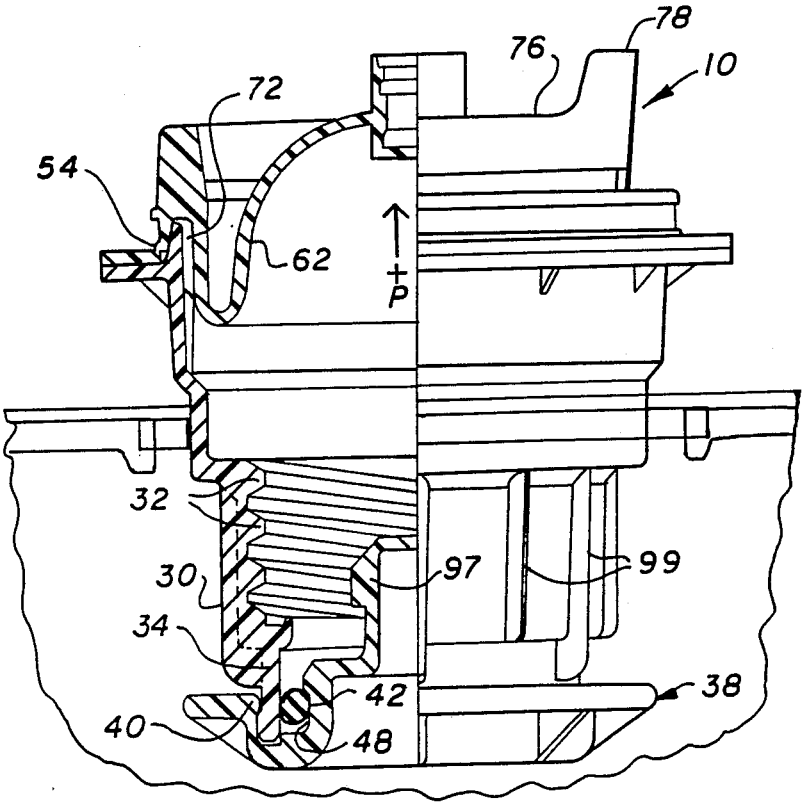
FIG. 6 is a view similar to FIG. 5 illustrating an altered configuration of the closure upon being subjected to a pressure environment exterior of the container which is less than the pressure within the container, such as is experienced during the cool-down cycle of sterilization in an autoclave.
Figure 7:
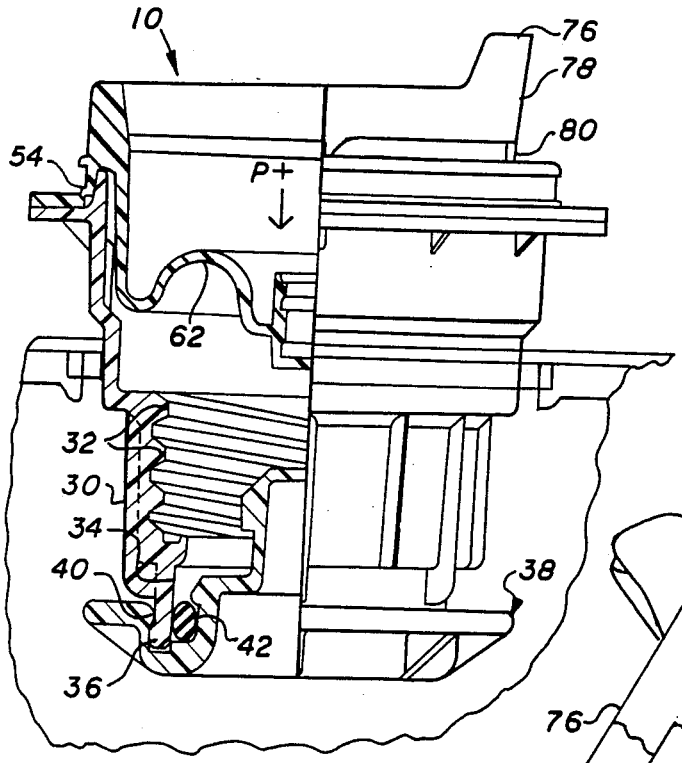
FIG. 7 is a view similar to FIGS. 5 and 6 illustrating an altered condition of the closure as a result of being subjected to a pressure environment exterior of the container which is greater than the pressure within the container, such as is also experienced in the course of sterilization in an autoclave.

The dome 62 and wall 60 of the closure 10 comprises an expansible bellows-type diaphragm 57 in that it will bend or roll at the wall convolutions and thus vary its configuration by flexing to vary the enclosed space to readily vary the enclosed volume within the port, as seen in FIGS. 5–7. Thereby the diaphram 57 will minimize the pressure differential between the interior of the port and the ambient atmosphere when the assembly is in an autoclave for sterilization purposes. This minimizes the forces generated within the cover member and minimizes rupture and removal forces on the tear line 58 and removal forces on the cap 38. The above referred variances of the enclosed space and enclosed volume within the port also allow for a captured sterile volume of air within the port. This captured volume reduces or eliminates the inrush of air upon opening of the closure and correspondingly reduces the risk of contamination.

The cover 10 typically is applied to flange 55 of the container port 20 during manufacture of the container 8. The diluent is added to the bag through port 100. The filled and sealed container assembly 8 is then placed in an autoclave for sterilization purposes. In the process of sterilization, an autoclave pressure is generated which is in excess of the pressure within the interior of the container 12 and within port 20. As a result, the diaphragm dome 62 is forced toward the interior of the container 12 generally in the manner illustrated in FIG. 7. As indicated in FIG. 7, the diaphragm dome 62 is flexed inwardly of the container and the outer diaphragm wall is bent or rolled inwardly of the container.

The ambient pressure in the autoclave in the later portion of the high temperature "peak dwell" period is less than that of the port interior, resulting in a pressure differential which forces the closure diaphragm 62 upwardly away from the bag interior generally in the manner of FIG. 6. Walls 60, 59 and 56 also may flex to accommodate this upward movement. During cool-down, the pressure in the autoclave again exceeds that in the port, as at the beginning.

Figure 14:
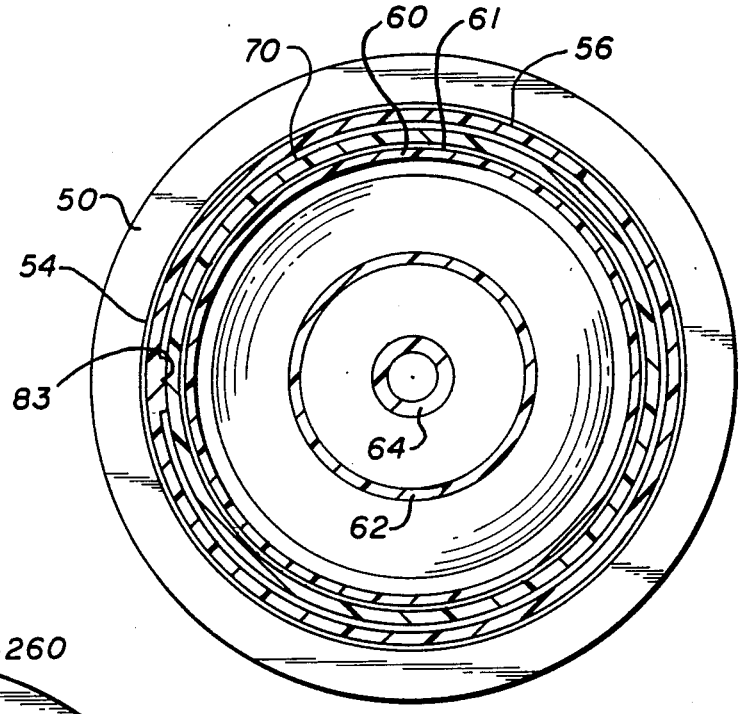
FIG. 14 is a sectional view taken generally along line 14—14 of FIG. 5.

As noted above, a stress relief wall or "fence" 70 is provided on the port, see FIG. 4. This fence comprises a distal end wall portion of port 20. It interfits within the annular channel 72 defined by surface 61 of wall 60 and inner surface 65 of cylindrical wall 56 of the cover 10, see FIGS. 3 and 5–8. Fence 70 is closely adjacent to the wall 56 and it is believed that the fence 70 and the related configuration of the cover 10 function to at least partially isolate tear line 58 from inwardly directed tensile forces generated in the cover, thereby protecting tear line 58 from unintentionally rupturing or tearing. Such forces may be generated in the cover member due to relative shrinkage or expansion of the closure components, or distortions within one or both components, as well as due to pressure differentials such as occur during autoclaving. In particular, if a shrinkable material such as PVC is used to form the cover and the port is dimensionally stable, e.g., formed of a polyester, the relative shrinkage factor and attendant forces may be significant. Those forces of course are in addition to the forces due to pressure differentials across the cover. It appears that abuttment of the wall 56 with the fence 70 at least contributes to the stress relief function. In that regard, the respective parts may be of designs and such relative dimensions that the annular wall of the cover abuts the fence upon initial assembly. However, it has been found in a current commercial embodiment that an initial radial spacing of about 0.050" between the cover wall 56 and the fence 70, as illustrated in FIG. 14, functions satisfactorily. In that commercial embodiment, the port is molded of polyester with a fence wall 70 of about 1.30" outside diameter and about 0.13" height above flange 55. The cover is molded of plasticized PVC with inert fillers as previously discussed, and wall 56 is about 0.02" thick and extends axially about 0.06" over the upper portion of fence 70. In actual use, the shrinkage and other tensile forces apparently bend and otherwise distort the wall 56 such that at least upper portions thereof contact the fence 70 and are supported by the fence as tension forces generated within or applied to the center portions of the cover pull inwardly on that upper portion.

The fence 70 is illustrated as an annular wall which presents a continuous annular outer support surface or series of surfaces to the cover wall 56. However, it is believed that this fence also could be a series of spaced support sections, posts or rings provided that it is of sufficient height, and the open spaces sufficiently small, as to substantially prevent the cover from being pulled radially inward at the tear line.

It is therefore seen that the restraining fence 70 of the port 20 and the related portions of the cover function as a stress relief for the tear line of the flexible cover 10. Further the diaphragm design enables differentials in pressure between the interior of the port 20 and an autoclave ambient atmosphere to be minimized without deleterious consequences to the frangible seal 54 of the closure.

As above noted, the container 8 is designed for intermixing into the diluent contents 18 thereof a medicament which is added by way of a vial which interconnects with port 20. Prior to such interconnection the center section of the cover is removed by tearing the cover along tear line 58 to expose the port. This removal is effected by pulling on a pull ring 76 in the manner of FIG. 8.

Figure 8:
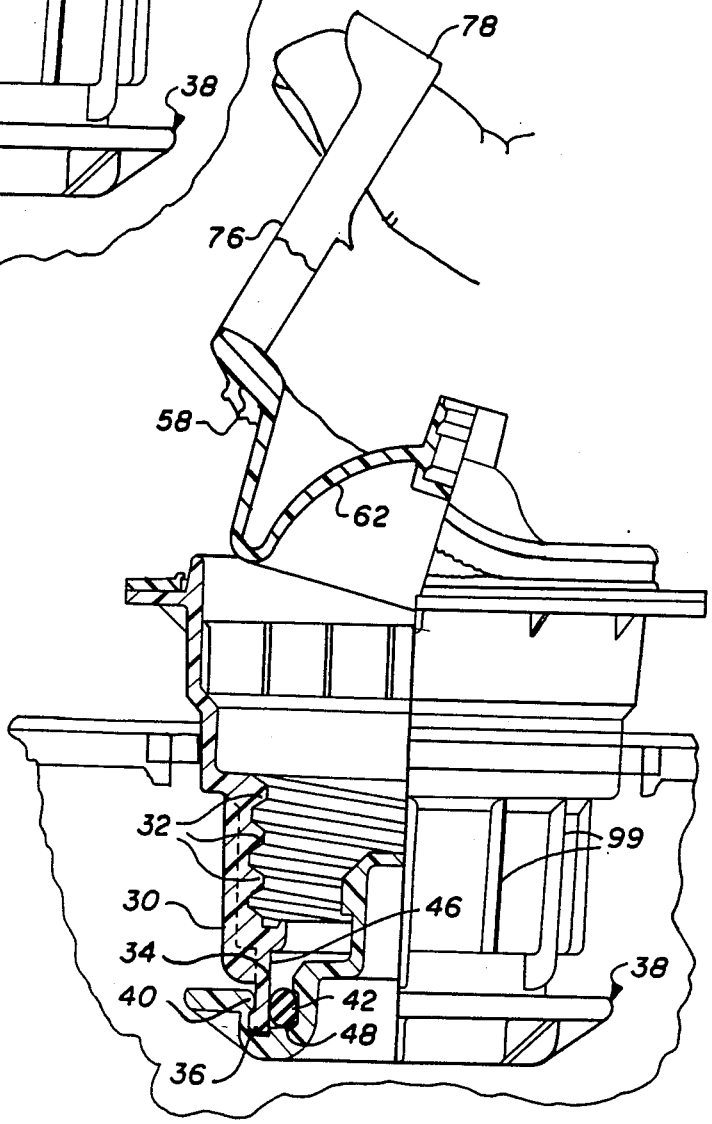
FIG. 8 is an elevational view partly in section of the container of FIG. 5 in the course of having the frangible portion of the cover torn pursuant to removal of the central portion of the cover.
Figure 9:
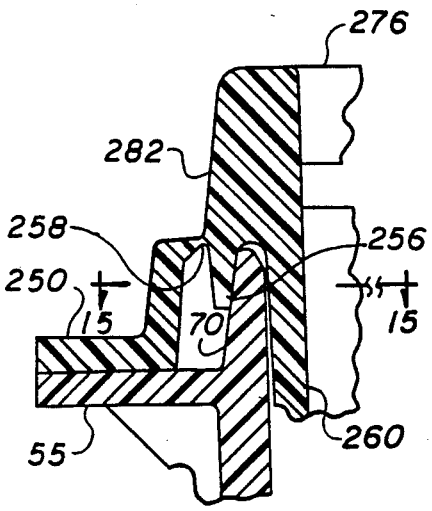
FIG. 9 is an enlarged fragmentary sectional view illustrating the frangible seal in a modified cover member employing teachings of this invention, and its attachment to a port to be sealed thereby.

The pull ring 76 is molded integrally with the annulus 59, being attached thereto by means of a narrow force-concentrating post 82. The latter is most clearly seen in FIGS. 2 and 4. The ring also is temporarily attached to the annulus 59 by thin breakable integral stringers 80 for purposes of holding the ring in position on the cover during manufacture, assembly and handling. Upon engaging pull ring 76 at the enlarged finger-locating tab 78 and pulling in an upwardly direction so as to pull closure wall portion 56 relative to bead 54, the thin stringers 80 are readily broken. The leading edges of the side stringers, toward the tab 78, are arcuate at their merger into the ring as seen in FIGS. 4–7 and 10 to prevent inadvertent tearing of the ring at those points when breaking the stringers. When the ring 76 is pulled upwardly, generally as shown in FIG. 8, the post 82 causes the user's pulling force to be concentrated in a narrow area of the wall 56 and to be applied to a short length of the tear line 58. A narrow thickened portion of wall 56, seen at 83 in FIGS. 3 and 14, effectively forms an extension of the post 82 to assist in this force concentration. The frangible membrane is thus readily burst or broken to initiate a tearing action which then proceeds progressively along the tear line in each direction in the manner illustrated in FIG. 8. The entire diaphragm and remaining cover portions integrally formed therewith within the circle of the tear line thus may be readily torn free and detached from the cover portions 50 and 54 which remain secured to the sleeve flange 55. Upon such removal the inrush of air will be minimized, based upon the configuration and manner of removal of the center portion of the cover, whereby contamination is minimized. The initial oversize of wall 56 relative to the periphery of the fence 70 and the attendant initial radial spacing therebetween insure that the wall 56 will be easily removable from the fence despite shrinkage of the wall during sterilization.

The sleeve port 20 is then completely exposed and open for insertion of a vial of medicament such as vial 88 illustrated in FIG. 10. Male threads 90 disposed about neck 93 of vial 88 threadably engage the female threads 32 formed on the interior of the cylindrical portion 30 of sleeve 20. Ratchet teeth **89*a* on the vial enclosure also engage complementary teeth 89*b* on the port to preclude removal of the vial once engagement is initiated. In the course of connecting the vial 88 into the port 20, a projecting arrow or prong-shaped head 97 integrally formed with closure cap 38 will pass into a recess 92 of vial stopper 94 such that the annular shoulder 96 of the head 97 will engage behind an annular ledge 98 of stopper 94. Projecting ribs 99 formed on the outer surface of sleeve portion 30 reinforce that portion. An annular sealing lip 101** on the port abuts the end finish of the vial to provide a sealed connection between the port and the neck of the sealed vial.

The contents 89 of vial 88 are released into the container 8 by removing the cap 38 from engagement with the terminal bead 36 of the port 20. Manual disengagement of the cap from the port end is readily effected by manipulation of the cap by the user through the flexible container walls 14. Simultaneously with the cap removal, the stopper 94 of the vial 88 will be removed as a result of its interlocking engagement with the projection 97 on the cap 38.

Following stopper and cap removal the medicament 89 contained in the vial 88 will pour into the diluent 18. The flexible container 12 may be appropriately manipulated to ensure desired and complete mixing of the medicament within the diluent. The medicament may be any of a variety of powdered or liquid pharmaceutical products, vitamins or nutritional preparations to form the desired mixture with the diluent. The resulting desired mixture may then be dispensed through administration port 100 having a cap closure 102. (See FIG. 4).

Figure 11:
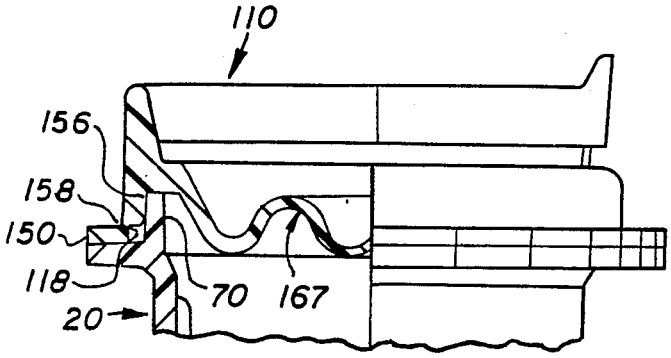
FIG. 11 is a partial sectional view of a modified closure assembly in which the pressure responsive, expansible diaphragm is formed with concentric corrugations.

Although the cover 10 employs a diaphragm 57 having a dome 62 and reverse-folded flexible side walls, it will be apparent that the diaphragm portion which is able to telescopically react to pressure differentials may vary as in cover 110 of FIG. 11. In the embodiment of FIG. 11, parts are identified by numbers in the 100 series corresponding to the numbers assigned to corresponding parts in the embodiment described above. Cover 110 has a diaphragm portion 167 comprising a concentric arrangement of contiguous convolutions or corrugations of alternate convex and concave configuration. The diaphragm 167 can expand in either direction axially of the port 20 by flexing when exposed to pressure differentials. Cover 110 has a cylindrical wall portion 156, having an inner surface which is snugly received around a supporting port wall 70 which functions as a strain relief as previously described in connection with closure 10. In closure 110 an annular notch 118 defines a thin frangible tear line 158 between attachment flange 150 and cylindrical wall 156.

Figure 12:
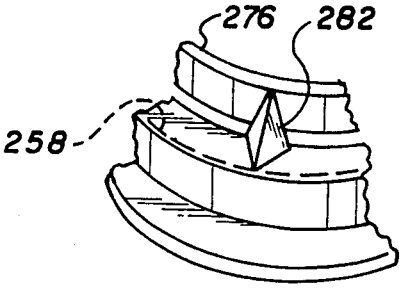
FIG. 12 is a partial perspective view of the cover illustrated in FIG. 9.
Figure 13:
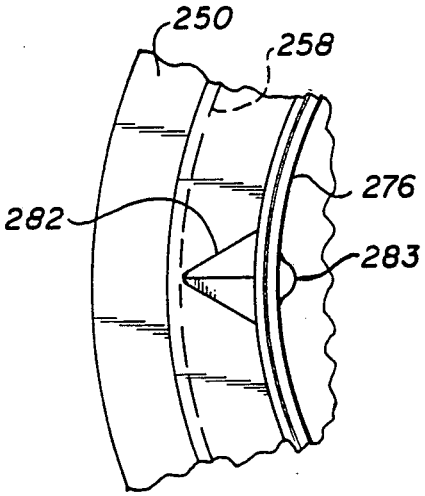
FIG. 13 is a partial top view of the force-concentrating post portion of the cover illustrated in FIG. 9.
Figure 15:
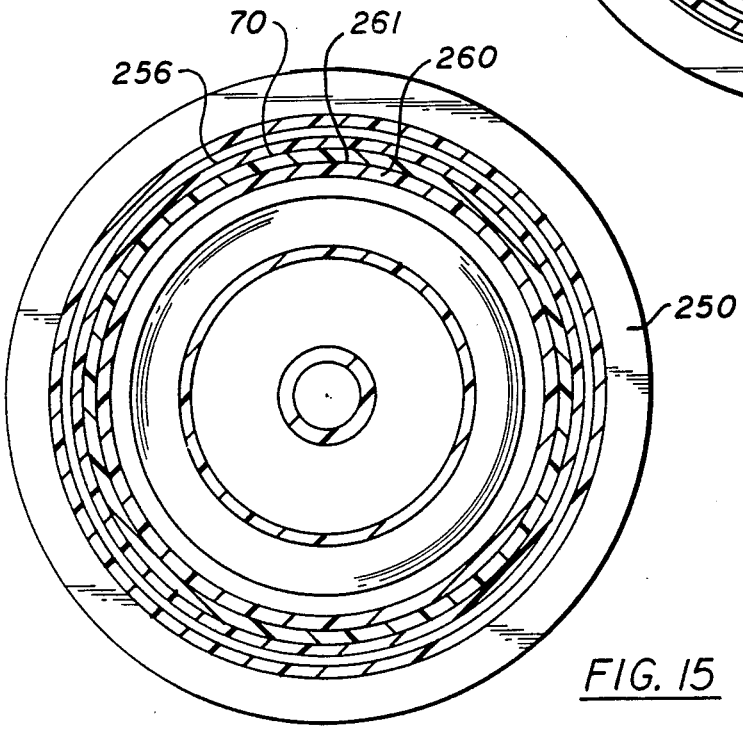
FIG. 15 is a sectional view similar to FIG. 14 taken generally along line 15—15 of FIG. 9.

FIGS. 9, 12, 13 and 15 illustrate another embodiment of the invention. In the embodiment of these Figures, parts are identified by numbers in the 200 series corresponding to the numbers assigned to corresponding parts in the embodiments described above. The embodiment of FIGS. 9, 12, 13 and 15 includes a modified frangible tear line 258 which is elevated from the attachment flange 250 and disposed adjacent to the upper surface of and essentially coplanar with the base of the force concentration post 282. The tear line thus passes closely adjacent to the base of the post 282 such that the pull force applied through the post has little opportunity to spread through intervening materials and thus is more highly concentrated than in the embodiment of FIGS. 1–8. The post 282 also is V-shaped in cross-section, as best seen in FIGS. 12 and 13, with the point over the tear line 258 to even more narrowly or precisely focus the initial bursting force on the tear line when the user pulls on ring 276. An inner reinforcing rib 283 overlaps the back side of post 282 and the upper portion of wall 260. As illustrated in FIG. 15 wall 256 of this embodiment also is contiguous to the fence 70, as in the embodiment of FIG. 9.

It is thus seen that a novel closure has been provided which meets the aforestated requirements and objects.

The foregoing has made apparent a number of equivalent embodiments of the inventive features above described in detail. Accordingly, it is intended that the scope of this invention be limited only by the scope of the following claims.

What is claimed is:

1. A container comprising a wall;

a port structure which defines an access opening through said wall; and a thin flexible fluid-tight cover member over said opening;

said port structure including a support portion axially extending outwardly from said container and defining said opening internally thereof, said support portion defining axially extending and transversely radially outwardly exposed support surfaces circumjacent the axially outward end of said support portion;

said cover member comprising a first portion extending across the outward end of said support portion and including an expansible diaphragm section exposed to said opening, a non-frangible second portion integral with said first portion and disposed radially outward of and circumjacent said external radially outwardly exposed support surfaces, a third portion affixed to said port structure, and a frangible portion defining a tear line between said second portion and said third portion, whereby said second portion may engage said radially outwardly exposed support surfaces for stress-relief protection of the integrity of said tear line from stresses in said first and second portions of said cover, and severance of said tear line permits removal of a section of said cover including said first and second portions to uncover said access opening.

2. The invention as in claim 1 wherein said port structure includes an annular portion disposed adjacent said support portion and said third portion of said cover is bonded to said annular portion of said port structure.

3. The invention as in claim 2 wherein said tear line of said cover is disposed between said support portion and said annular portion of said port structure.

4. The invention as in claim 2 wherein said annular portion is an annular flange extending radially outward from said support portion, said third portion of said cover is bonded to said annular flange, and said tear line is disposed adjacent the inner peripheral edge of said third portion.

5. The invention as in claim 1 wherein said second portion is an annular portion having first and second edges, said first portion of said cover being integral with one of said edges of said second portion and said frangible portion being at the other of said edges of said second portion.

6. The invention as in claim 1 wherein said frangible portion extends outward from the side to said second portion which is remote from said support surfaces.

7. The invention as in claim 6 wherein said second portion is an annular portion having first and second edges, said first portion of said cover being integral with one of said edges of said second portion and said tear line being along the other of said edges of said second portion.

8. The invention as in claim 6 wherein said second portion and said first portion of said cover are joined to one another along a junction and said frangible portion is joined to said second portion adjacent said junction.

9. The invention as in claim 6 wherein said second portion and said first portion are joined to one another along a junction and said tear line is disposed adjacent said junction.

10. The invention as in claim 1 wherein said port structure and said cover are formed of materials having substantially different co-efficients of expansion from one another.

11. The invention of claim 10 wherein said port structure is formed of a material which is dimensionally stable through steam sterilization temperature ranges and said cover is formed of a material having a negative coefficient of expansion.

12. The invention of claim 11 wherein said port structure is formed of a polyester and said cover is formed of polyvinyl chloride.

13. The invention of any of claims 1 through 12 wherein said second portion of said cover is disposed contiguous to said support surfaces of said port structure.

14. The invention of any of claims 1 through 12 wherein said tear line and at least a part of said second portion of said cover are disposed in spaced relation to said support surfaces of said port structure.

15. The invention of any of claims 1 through 12 wherein said diaphragm section is an expansible diaphragm section which is expandable telescopically inwardly and outwardly relative to said port structure.

16. The invention as in claim 15 wherein said diaphragm section includes at least one annular convolution whereby said diaphragm section is expandable by flexing of said convolution to permit movement, generally axially of said port structure, by the portion of said cover within said convolution.

17. In combination with a port member having an outer periphery in fluid-tight engagement with a first container and having a first portion disposed exteriorly of said first container; said first port portion including an annular portion presenting a peripheral surface around such port member; a thin flexible fluid-tight cover for said port member, said cover having a frangible section and comprising: a first portion circumscribing said port first portion and affixed in fluid-tight sealing engagement with said peripheral surface around such port member; a removable section for spanning said port, said removable section including a diaphragm portion and a non-frangible generally cylindrical wall portion around said diaphragm portion; said non-frangible cylindrical wall portion being connected to said first portion along a tear line disposed outwardly of said non-frangible wall portion relative to said diaphragm portion for defining said frangible section; said port first portion including a fence portion disposed adjacent the inner surface of said non-frangible wall portion of said cover for abutting stress relief engagement of said non-frangible cylindrical wall portion with outer surfaces of said fence portion, for providing stress relief for said tear line; and manually engageable means for pulling said removable section relative to said first portion and initiating tearing of said frangible section.

18. The invention as in claim 17 wherein said first portion of said cover is an annular flange extending radially outward from said cylindrical wall portion.

19. The invention as in claim 18 wherein said tear line is adjacent the inner peripheral edge of said first portion of said cover.

20. The invention as in claim 17 wherein said wall portion has first and second annular edges, said diaphragm portion of said cover being integral with one of said edges of said wall portion and said tear line is at the other of said edges of said wall portion.

21. The invention as in claim 17 wherein said tear line extends from the radially outward surface of said wall portion.

22. The invention as in claim 21 wherein said wall portion has first and second annular edges, said diaphragm portion of said cover being integral with one of said edges of said wall portion and said tear line being at the other of said edges of said wall portion.

23. The invention as in claim 21 wherein said wall portion and said diaphragm portion of said cover are joined to one another along a junction, and said tear line is disposed adjacent said junction.

24. The invention of any of claims 17 through 23 wherein said diaphragm portion is an expansible diaphragm section which is expandable telescopically inwardly and outwardly relative to such a portion.

25. The invention as in claim 24 wherein said diaphragm section includes at least one annular convolution whereby said diaphragm section is expandable by flexing of said convolution to permit movement, generally axially of said port, by the portion of said cover within said convolution.

26. The invention of claim 17 in which said port member has a second portion disposed within said container, and said second portion has means therewithin for engaging a second container in fluid-sealing engagement; and a detachable sealing closure closing the inner end of said second portion.

27. The invention as in claim 17 in which said port member is formed of a polyester resin having dimensional stability when exposed to elevated temperatures.

28. The invention as in claim 27 wherein said cover is formed of polyvinyl chloride.

29. The invention of any of claims 1 through 12 or 17 through 23 including pulling means for manually applying a pulling force to a limited segment of said tear line for initiating tearing thereof.

30. The invention of claim 29 wherein said pulling means includes a narrow post element which is integral with said removable section of said cover in an area adjacent said second portion or wall portion, respectively, for transmitting rupture forces to a limited segment of said tear line, and means for manually applying pulling force to said post.

31. The invention of claim 30 wherein said post is wedge-shaped in cross-section and the narrow portion of said wedge is disposed adjacent said second portion or wall portion, respectively, of said cover.

32. The invention of any of claims 1, 2, 3, 4, 6, 8, 9, 10, 11, 12, 17, 18, 19, 21 or 23 including pulling means for manually applying a pulling force to a limited segment of said tear line for initiating tearing thereof, said pulling means including a narrow post element which is integral with said removable section of said cover adjacent said tear line for transmitting rupture forces to a limited segment of said tear line, and means for manually applying pulling force to said post.

33. The invention of claim 32 wherein said post is wedge-shaped in cross-section and the narrow portion of said wedge is disposed adjacent said tear line.

34. A container comprising a wall;

a port structure which defines an access opening through said wall; and a thin flexible fluid-tight cover member over said opening;

said port structure including a support portion extending outwardly, longitudinally of said container and defining external support surfaces circumjacent said opening;

said cover member comprising a first portion extending across the outward end of said support portion and including an expansible diaphragm section exposed to said opening, said diaphragm section including at least one annular convolution whereby said diaphragm section is expandable by flexing of said convolution to permit telescopic movement of the portion of said cover within said convolution inwardly and outwardly relative to said port structure, a second portion integral with said first portion and including a wall section disposed circumjacent said external support surfaces, a third portion affixed to said port structure, and a frangible portion defining a tear line between said second portion and said third portion, whereby said second portion may engage said support portion for stress-relief protection of the integrity of said tear line from stresses in said first and second portions of said cover, said first portion and said second portion constituting a removable section which is severable from the remainder of said cover by tearing along said tear line, a narrow post element integral with said removable section of said cover in an area adjacent said wall section for transmitting rupture forces to a limited segment of said tear line, and means for manually applying pulling force to said post for rupturing said tear line and subsequent removal of said removable section of said cover to uncover said access opening.

35. A flexible fluid-tight cover for a port of a container, said cover having a frangible section and comprising: a first portion for circumscribing such port and for sealing securement to a peripheral surface around such port; a removable section for spanning said port, said removable section including a diaphragm portion and a generally cylindrical wall portion around said diaphragm portion; said diaphragm portion including at least one annular convolution whereby said diaphragm section is expandable by flexing of said convolution to permit movement, generally axially of such a port, by the portion of said diaphragm portion within said convolution; said cylindrical wall portion being disposed for abutting stress relief engagement with outer, axially extending surfaces of such a port and connected to said first portion along a tear line disposed outwardly of said wall portion relative to said diaphragm portion for defining said frangible section; and manually engageable means for pulling said removable section relative to said first portion and initiating tearing of said frangible section, said pulling means including a narrow post element which is integral with said removable section of said cover in an area adjacent said wall portion for transmitting manual pulling forces to a limited segment of said tear line.

36. In a combination, a container in which a diluent is disposed and having a flexible wall and a longitudinally extending port defining an access opening through said wall; said port having a first distal end portion disposed exteriorly of said container and a second distal end portion disposed interiorly of said container; said port having an encompassing peripheral surface disposed exteriorly of said container and including a longitudinally extending external surface portion circumjacent the outward end of said first distal end portion; a thin flexible fluid-tight cover for the first distal end portion of said port; said cover having a frangible section and comprising a first portion for circumscribing such port and for sealing securement to the port peripheral surface; said cover also having a removable section for spanning said port; said removable section including an expansible diaphragm portion and a non-frangible generally cylindrical wall portion around said diaphragm portion; said non-frangible cylindrical wall portion being disposed for abutting stress relief engagement of the inner surfaces thereof with said external surface portion of such port and connected to said cover first portion along a tear line disposed outwardly of said non-frangible cover wall portion relative to said diaphragm portion for defining said frangible section, whereby said removable section may be removed by severing said cover along said tear line; and a closure cap in fluid-tight engagement with said port second distal end portion and removable from engagement with said port from the exterior of said container.

37. The invention of claim 36 in which a medicament container having one end with a fluid-tight stopper disposed therein engages said port in fluid-tight engagement after said closure removable section is removed from engagement with said port first distal end portion; said fluid-tight stopper and said closure cap being formed for interlocking engagement when such medicament container engages said port in fluid-tight engagement, and said closure cap being removable from said port second distal end portion from the diluent container exterior whereby the medicament in said medicament container may enter said diluent upon removal of said closure cap from said port second distal end portion and the simultaneous removal of said stopper from said medicament container.

38. The invention of claim 37 in which said medicament container has an externally threaded neck and said port has an internally threaded portion whereby a threaded engagement may be effected between said medicament container and said port.

39. The invention of claim 1 in which the port axially extending support portion extends substantially coaxially with the container longitudinal axis and at substantially right angles to the port structure secured to the cover third portion.

40. A container comprising a wall;

a port structure which defines an access opening through said wall; and a thin flexible fluid-tight cover member over said opening;

said port structure including a support portion axially extending outwardly from said container and defining external support surfaces circumjacent said opening;

said cover member comprising a first portion extending across the outward end of said support portion and including an expansible diaphragm section exposed to said opening, said diaphragm section being expandable telescopically inwardly and outwardly relative to said port structure, a non-frangible second portion integral with said first portion and disposed circumjacent said external support surfaces, a third portion affixed to said port structure, and a frangible portion defining a tear line between said second portion and said third portion, whereby said second portion may engage said support portion for stress-relief protection of the integrity of said tear line from stresses in said first and second portions of said cover, and severance of said tear line permits removal of a section of said cover including said first and second portions to uncover said access opening.

* * * * *

UNITED STATES PATENT AND TRADEMARK OFFICE

CERTIFICATE OF CORRECTION

PATENT NO. : 4,757,911

DATED : July 19, 1988

INVENTOR(S) : Mark E. Larkin; Edward S. Tripp; John S. Ziegler

It is certified that error appears in the above—identified patent and that said Letters Patent is hereby corrected as shown below:

Col. 1, line 21: Change "Pat. No. 4,614,567" to --Pat. No. 4,614,267--

Signed and Sealed this

Twenty-eighth Day of February, 1989

*Attest:*

DONALD J. QUIGG

*Attesting Officer*

*Commissioner of Patents and Trademarks*